United States Patent [19]

Morgrey

[11] Patent Number: 4,570,846

[45] Date of Patent: Feb. 18, 1986

[54] MAILBOX SIGNALLING DEVICE

[76] Inventor: Richard T. Morgrey, 913A N. Beach Rd., Bow, Wash. 98232

[21] Appl. No.: 683,262

[22] Filed: Dec. 18, 1984

[51] Int. Cl.[4] ..... A47G 29/12

[52] U.S. Cl. ..... 232/35; 232/34

[58] Field of Search ..... 232/35, 34, 37, 36, 232/17

[56] References Cited

U.S. PATENT DOCUMENTS

| | | | |
|---|---|---|---|
| 2,356,020 | 8/1944 | Westerfield | 232/35 |
| 2,693,314 | 11/1954 | Hunter | 232/35 |
| 2,812,130 | 11/1957 | Abell | 232/35 |
| 2,924,376 | 2/1960 | Johnson | 232/35 |
| 3,014,641 | 12/1961 | Sowton | 232/35 |
| 3,291,386 | 12/1966 | Van Fleet | 232/35 |
| 3,498,255 | 3/1970 | Haeberle | 232/35 |
| 3,889,874 | 6/1975 | Arwood | 232/35 |
| 4,113,117 | 9/1978 | Hansicker | 232/35 |
| 4,190,193 | 2/1980 | Smith | 232/35 |

*Primary Examiner*—Robert Peshock
*Assistant Examiner*—John G. Weiss
*Attorney, Agent, or Firm*—Hughes & Cassidy

[57] ABSTRACT

A housing mounted to the side of a conventional rural mailbox by means of strap extending circumferentially around the mailbox. The housing has a signal flag movable between a down non-signalling position and an up signalling position. There is an elongate actuating rod extending between the front door of the mailbox and the pivot location of the signalling member. Opening of the mailbox door causes the actuating rod to move to a release position to permit the signal member to move upwardly to its signalling position.

9 Claims, 5 Drawing Figures

MAILBOX SIGNALLING DEVICE

BACKGROUND OF THE INVENTION

1. Field of the Invention

The present invention relates to a device to signal when the door of a mailbox has been opened so that it is possible to determine from a distance whether or not mail may have been inserted into the mailbox.

2. Background Art

It is quite common for rural mailboxes to be located along the edge of a roadway at a distance from the residence of the mail recipient. Such mailboxes are commonly provided with a signal flag that can be moved from a horizontal position to a vertical position. However, this flag is intended primarily for the resident to signal to the postman that there is an article in the mailbox to be picked up, and to the best knowledge of the applicant, it is not customary for the postman to raise that signal flag when mail is delivered. Thus, it becomes necessary for the recipient to actually open the door of the mailbox to determine whether or not mail has been deposited therein. In view of this, there have been a number of proposals for automatic signal devices to indicate when the door of the mailbox has been opened, this being an indication that mail has been delivered to the mailbox, since the postman is ordinarily the only person (other than the recipient) to open the mailbox under normal circumstances.

A search of the U.S. patent literature has disclosed a number of such devices. To the best knowledge of the applicant, such devices have not been widely accepted, even though the intended result of such devices would provide a substantial convenience to people who have rural mailboxes. Accordingly, it is believed by the applicant that there is a need to provide for rural mailboxes a signalling device which is practical, reliable, easy to install and operate, and of a design which is relatively economical to manufacture.

The devices which were disclosed in the prior art patents are the following:

U.S. Pat. No. 4,113,170, Hunsicker, shows a signal where there is a flag that has a first horizontal position and a second upright position. The flag is mounted to a dome-like cover which is in turn rotatably mounted to a frame attached to the side of a mailbox. A coil spring is mounted around a stub axle, and this spring urges the flag upwardly toward its signal position. There is a finger which engages an element connected to the door of the mailbox, and this finger holds the flag in its down "non-signalling" position when the mailbox door is closed. Moving the mailbox door to the open position releases the finger to permit the flag to be moved up to its signalling position.

U.S. Pat. No. 4,065,050, Hunt, discloses another signalling device where there is a base member attached to the bottom side portion of the mailbox. The signal member is pivotally mounted to the rear of the mailbox, and is moved downwardly and forwardly to its non-signalling position. There is a "trigger" that includes a lever that is released by the mailbox door moving downwardly to its open position. This lever releases the signal member which then is moved by a spring device to its up signalling position.

U.S. Pat. No. 3,958,752, Pieszchala, shows a signalling device that is mounted to the rear of a mailbox. There is a cord having one end attached to the door of the mailbox, and the other end of the cord is attached to a release pin which holds the signal flag in its down position. Opening the mailbox pulls the release cord to permit the flag to move to its up position.

U.S. Pat. No. 3,498,255, Haeberle, illustrates another signal device where there is a flag that is urged by a spring to move upwardly to a signal position. There is a rod that is urged by a spring forwardly against the mailbox door. This rod member also has a compression spring which urges a cam member into engagement with a second cam member that is rotatable with the signal flag. Opening of the door permits the rod member to spring forwardly, which in turn causes the cam member to move to a release position, thus permitting the flag to move up to its signalling position.

U.S. Pat. No. 3,291,386, VanFleet, shows a signal device where there is a spring loaded member mounted within the mailbox at the location of the door. This is connected by a wire to a release mechanism mounted at the rear of the mailbox. Opening of the door causes the wire to move the release mechanism to its release position to permit the flag to spring upwardly to the signalling position.

U.S. Pat. No. 2,924,376, Johnson, illustrates a signal device that is pivotally mounted to the top of the mailbox near the forward end thereof. Opening of the mailbox door permits the flag to move upwardly to its signalling position. There is a latch pull that is urged by a spring downwardly and rearwardly. When the mailbox door is again closed, and when the flag is moved downwardly by the person opening the mailbox to its non-signalling position, the latch pall moves into a hold position to prevent the flag from springing upwardly until such time as the mailbox door is again opened.

U.S. Pat. No. 2,693,314, Hunter, shows a signal device that is pivotally mounted at the side forward portion of the mailbox. There is a release lever that is engaged by the mailbox door, and opening of the door permits this release lever to move to its release position.

In view of the foregoing, it is an object of the present invention to provide a signal device for a rural mailbox, which device can be easily installed on an existing mailbox, which can operate reliably and effectively, which does not interfere with the normal operation of the mailbox, and which has a design which lends itself to economical manufacture.

SUMMARY OF THE INVENTION

The signal device of the present invention is designed to be mounted to a mailbox that has a main containing structure with a side wall and a forward positioned door which is mounted to the containing structure so as to be movable between a closed position and an opened position. The device comprises a housing that is adapted to be mounted to an outside surface of the side wall of the mailbox at a mounting location. The housing has a rear housing portion to be positioned closer to the rear part of the mailbox and a forward housing portion extending forwardly from the rear housing portion toward the door of the mailbox.

There is a signal member having a pivot end mounted to the rear housing portion for rotation about a generally horizontal axis of rotation, and a signal end spaced from the axis of rotation. The signal member is movable about its axis of rotation between a down nonsignaling position and an up signaling position.

There is a locating member connected to the pivot end of the signal member and it has a locating element.

There is an actuating member mounted in the forward housing portion for forward and rearward movement between a rear hold position and a forward release position. The actuating member has a forward contact surface adapted to engage a side edge portion of the mailbox door when the door is in its closed position.

There is a catch member mounted to the rear end of the actuating member and having a catch position where it engages the locating element to hold the signal member in its nonsignaling position when the actuating member is in its hold position. The catch member has a release position to permit said signal member to move to its signaling position when the actuating member is in its release position.

Spring means are provided to urge the signal member toward its signaling position. The spring means also urges the actuating member toward its release position.

There is a mounting strap adapted to be connected to the housing and to extend around the mailbox to hold the signaling device substantially stationary at the mounting location. Desirably, the strap is connected to upper and lower forward portions of the rear housing portion, so that the device is reasonably balanced between forward and rear portions of the device relative to the strap.

In the preferred form, the housing comprises an inside housing section adapted to be positioned adjacent the mailbox side wall, and an exterior housing section to close the main housing section. The strap interfits with the exterior housing section so as to hold the cover in engagement with the inside housing section, and thus support the device. Desirably, there are upper and lower handles connected to, respectively, upper and lower portions of the exterior housing section, and the strap is adapted to fit through both of said handles to hold the cover in engagement with the main housing section.

In one embodiment, the actuating member is an elongate member the length of which is adjustable to allow for variations of engagement with the mailbox door. In this embodiment, the actuating member comprises two elongate sections interfitting with one another, and adjustable fastening means adapted to lock the two actuating sections relative to one another.

There are first and second stop means mounted to the housing and the actuating member respectively, with the stop means interengaging to limit forward and rearward movement of the actuating member. The housing portion defines a channel in which the actuating member is positioned. A stop recess is formed in either of the forward housing portion or the actuating member, and stop member means is formed in the other of the forward housing portion and actuating member. The stop member means and surfaces of the recess interengage to limit forward and rearward movement of the actuating member.

The preferred form of the spring means is that it comprises a compression spring engaging the actuating member and the housing in said forward housing portion. Desirably, the housing has a mounting hub on which the locating member is rotatably mounted. The spring means comprises a coil spring interfitting with the hub and the locating member to urge the locating member and the signal member to the signaling position.

In this specific configuration, the catch member comprises a catch finger pivotally mounted adjacent the rear end of the actuating member. The catch finger is located so that with the actuating member in its hold position, the catch finger lies in a path through which the locating element travels in movement of the signal member between its signaling position and its nonsignaling position. The catch finger is deflectable upwardly when contacted by the locating element as the signal member is moved to its nonsignaling position. Then the catch finger is movable back to a catch position to engage the locating element and hold the signal member in its nonsignaling position.

Other features of the present invention will become apparent from the following detailed description.

DESCRIPTION OF THE PREFERRED EMBODIMENT

Figure 1:
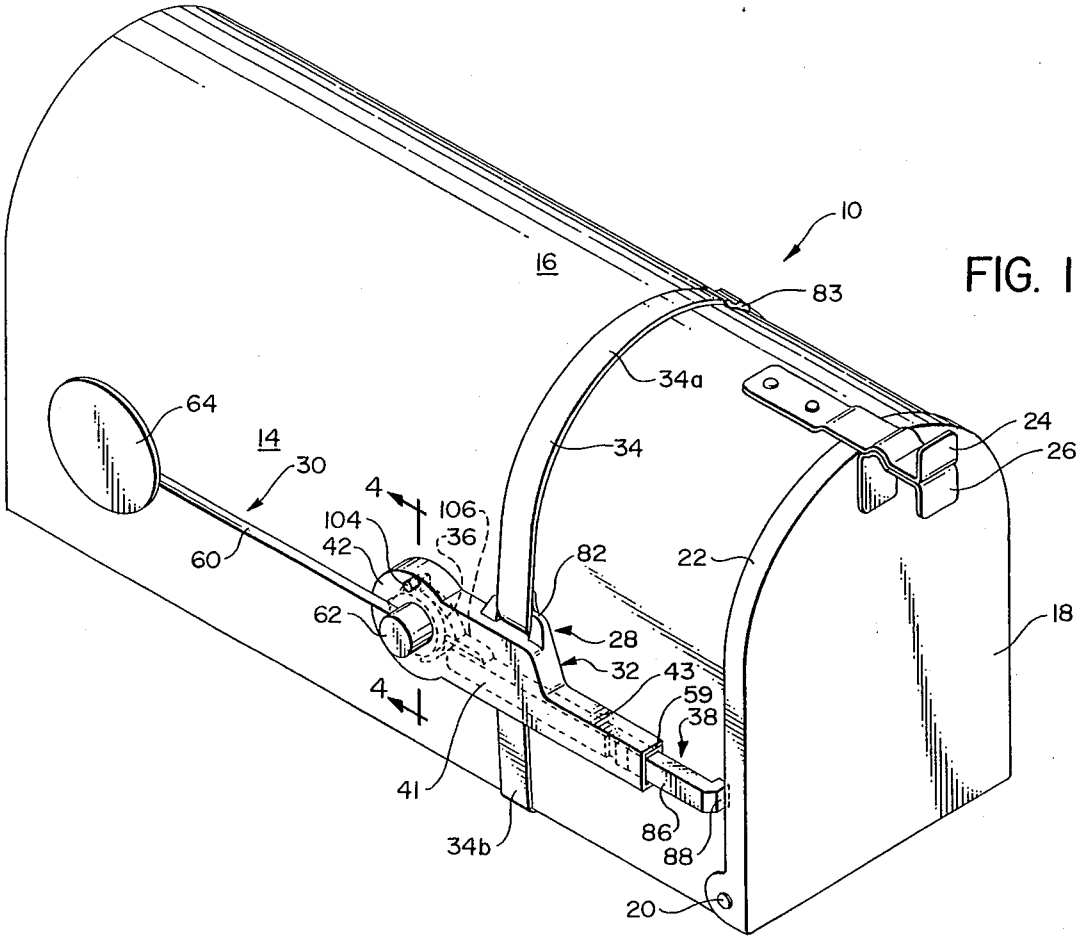
FIG. 1 is an isometric view of the apparatus of the present invention mounted to a conventional rural mailbox, with the signal flag in its down "non-signalling" position.
Figure 2:
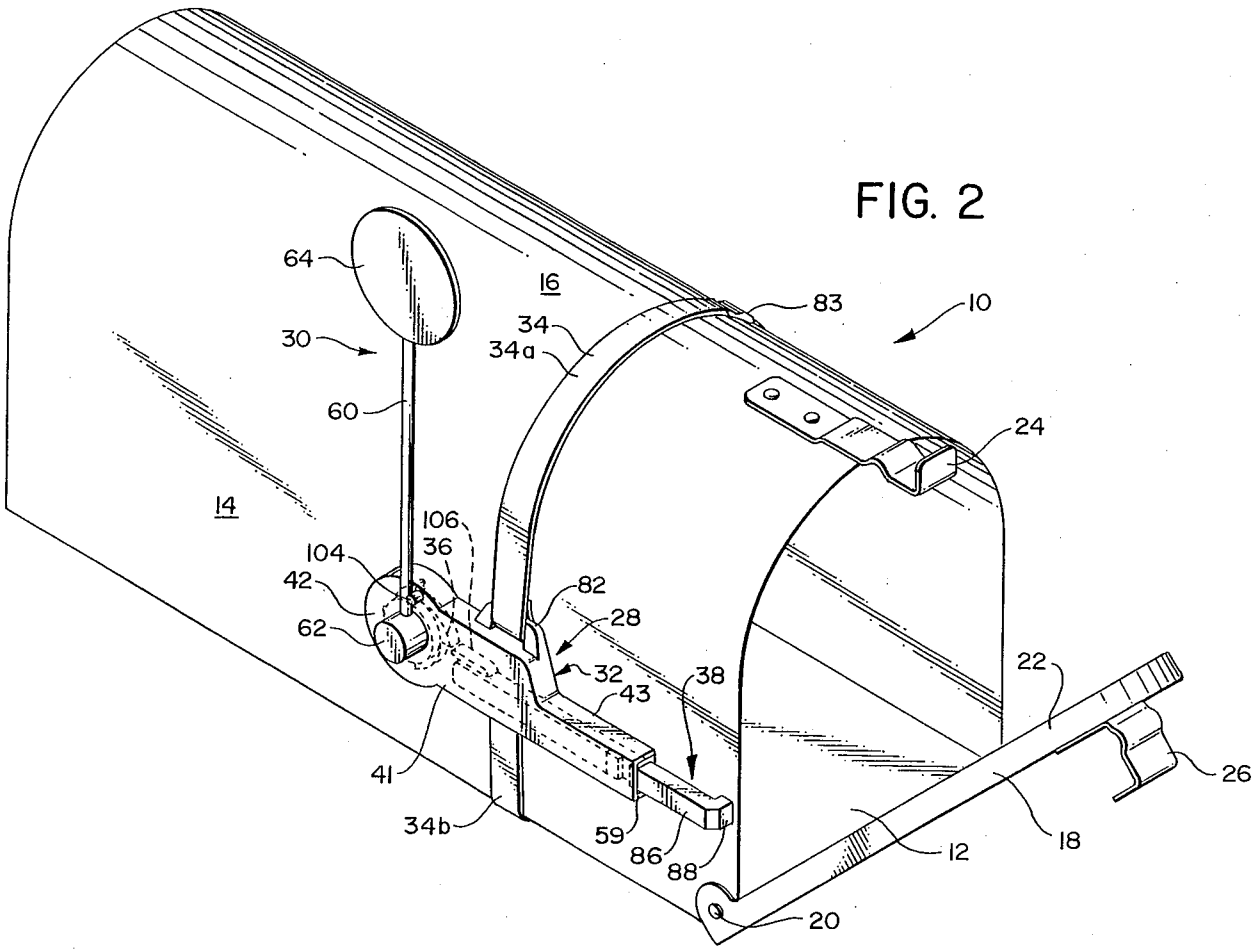
FIG. 2 is a view similar to FIG. 1, but showing the mailbox door opened, and with the flag having moved upwardly to its signalling position.

With reference to FIGS. 1 and 2, there is shown a conventional rural mailbox 10, having a bottom wall or floor 12, side walls 14 and a curved top wall 16, formed as a half cylinder and formed integral with the side walls 14. At the front of the box 10 there is a door 18 pivotally mounted at 20 to the lower front edge portion of the two side walls 14.

The door 18 has a peripheral lip or flange 22 which extends rearwardly from the upper and side edges of the door 18. With the door 18 in its closed position, the lip 22 extends rearwardly a short distance around the outer surface of the forward portions of the side walls 14 and top wall 16 of the box 10. Cooperating catch devices 24 and 26 are attached to the top portions of the box 10 and door 18, respectively, and these engage one another to releasably hold the door 18 in its closed position.

The components 10–26 described thus far are those which exist in many, if not most, conventional rural mailboxes which are currently in use. As will be disclosed more fully hereinafter in the following detailed description, the present invention is particularly adapted to be used in an especially convenient manner with such a conventional mailbox, not only with regard to ease of initial installation, but also effective and reliable use after initial installation.

The signalling device of the present invention is generally designated 28, and it comprises a signal flag 30, a housing 32, a mounting strap 34, a positioning member 36, and an actuating assembly 38.

The housing 32 comprises an inside housing section 40 and an exterior housing section 41 interfitting with the housing section 40. The inside housing section 40 is adapted to be positioned against the lower side portion of one of the side walls 14. For purposes of description, with the two housing sections 40 and 41 assembled, the housing 32 can be considered as having a main rear housing portion 42 and a forward elongate housing portion 43 extending forwardly from the rear housing portion 42 a short distance above the lower edge of the adjacent side wall 14. The rear portion of the inside housing section 40 comprises top and bottom walls 44 and 46, a rounded rear wall 48 and a downwardly and forwardly sloping intermediate wall 50. Positioned in the inside housing section 40 at the surface portion that is adjacent the mailbox side wall 14 is a cylindrical stub or mounting member 52, made integral with the section 40 and having an outer cylindrical surface 54 around which is positioned a coil spring (to be described later herein) connected to the positioning member 36. The inside housing section 40 is closed by the exterior housing section 41, the rear portion of which has peripheral sidewalls 44*a*, 46*a*, 48*a* and 50*a* that fit closely around the top, bottom, rear and intermediate walls 44–50 of the inside housing section 40.

The elongate forward housing portion 43 is made up of two elongate U-shaped sections 55 and 56 are made integral with the housing sections 40 and 41, respectively, and which interfit with one another so that the upper and lower walls 57 and 58 of the section 55 (which is part of the inside housing section 40) fit within, respectively, the upper and lower walls 57*a* and 58*a* of the section 56 (which is part of the exterior housing section 41). The forward end 59 of the elongate housing portion 42 terminates a short distance rearwardly of the front end of the mailbox 10.

The aforementioned signal flag 30 comprises a post or rod 60 attached at one end to a hub 62, and attached at the other end is a signal member 64, which is shown herein as a circular disc of a sufficient size (e.g. moderately over two inches in diameter) to be easily seen from a distance. The flag 30 has a rearwardly extending non-signalling position (shown in FIG. 1), and an upwardly extending signalling position (shown in FIG. 2). The hub 62 is positioned adjacent an opening 66 in the housing section 41 and is fixedly connected to a splined stub or axle 70 of the positioning member 36.

The positioning member 36 has a generally cylindrical configuration and is mounted for rotation about its center axis which extends laterally and horizontally perpendicular to the adjacent side wall 14 of the mailbox 10. The positioning member 36 is further provided with a coil spring 72 located around the stub 52. One end 74 of the spring 72 fits into a slot 76 formed in the aforementioned stub 52. The opposite end of the spring 72 is connected to the disc-like positioning member 36. The outer circumference of the positioning member 36 is provided with one or more outwardly extending positioning teeth 78 to hold the signal flag 30 in the down position.

The strap 34 comprises a first strap portion 34*a* having one end which connects to a handle 82 that is connected to the forward part of the top wall 44*a* of the housing section 41 and a second end that connects to a buckle 83. There is a second strap portion 34*b* having one end which connects to a second handle 84 that is connected to the forward part of the bottom wall 46*a* of the housing section 41, and a second end connecting to the buckle 83. As the strap 34 is tensioned, it tends to pull the housing section 41 into secure engagement with the inside housing section 40, and also hold the entire housing 32 securely in place adjacent the mailbox side wall 14.

The actuating assembly comprises an elongate rod member 86 positioned in the housing 32. The forward end 88 of the rod member 86 extends beyond the front edge 58 of the forward housing portion 43. The rear end 90 of the rod member 86 extends into the rear housing portion 42 and terminates a short distance forwardly of the locating member 36.

The inside surface portion of the rod member 86 is formed with an elongate slot 92 to receive a compression spring 94. The U-shaped housing section 55 has mounted therein a spring stop 96. In the assembled position, the spring 94 is positioned so that its rear end bears against the spring stop 96, and its forward end bears against a forward surface portion 98 that defines the forward end of the slot 92. Thus, the spring urges the rod member 86 forwardly toward the door 18 of the mailbox 10.

To limit the forward and rearward movement of the rod member 86, the outwardly facing surface of the rod member 86 is formed with a recess 100. There is mounted to the inside surface of the housing section 56 a stop member 102 having an axial dimension (i.e. a dimension parallel to the lengthwise axis of the rod member 86) moderately smaller than the axial dimension of the recess 100. Thus, in the assembled position, the stop member 102 is located within the recess 100 and limits the forward and rearward movement of the rod member 86.

At the upper edge of the housing section 41, there is a flag stop member 104 to limit the upper and forward movement of the signal flag 30 so as to locate the flag 30 in its upright position, as shown in FIG. 2.

Mounted to the rear end 90 of the rod member 86 is a positioning finger 106 having a pivot end 108 having a circular recess to engage a pivot pin 110 positioned just a short distance forwardly of the extreme rear end of the rod section 86. The finger 106 is positioned immediately above the rod member 86 and extends rearwardly from the rear end 90 to terminate in an outer finger end portion 112 that extends a moderate distance rearwardly beyond the rear end of the rod member 86.

Figure 3:
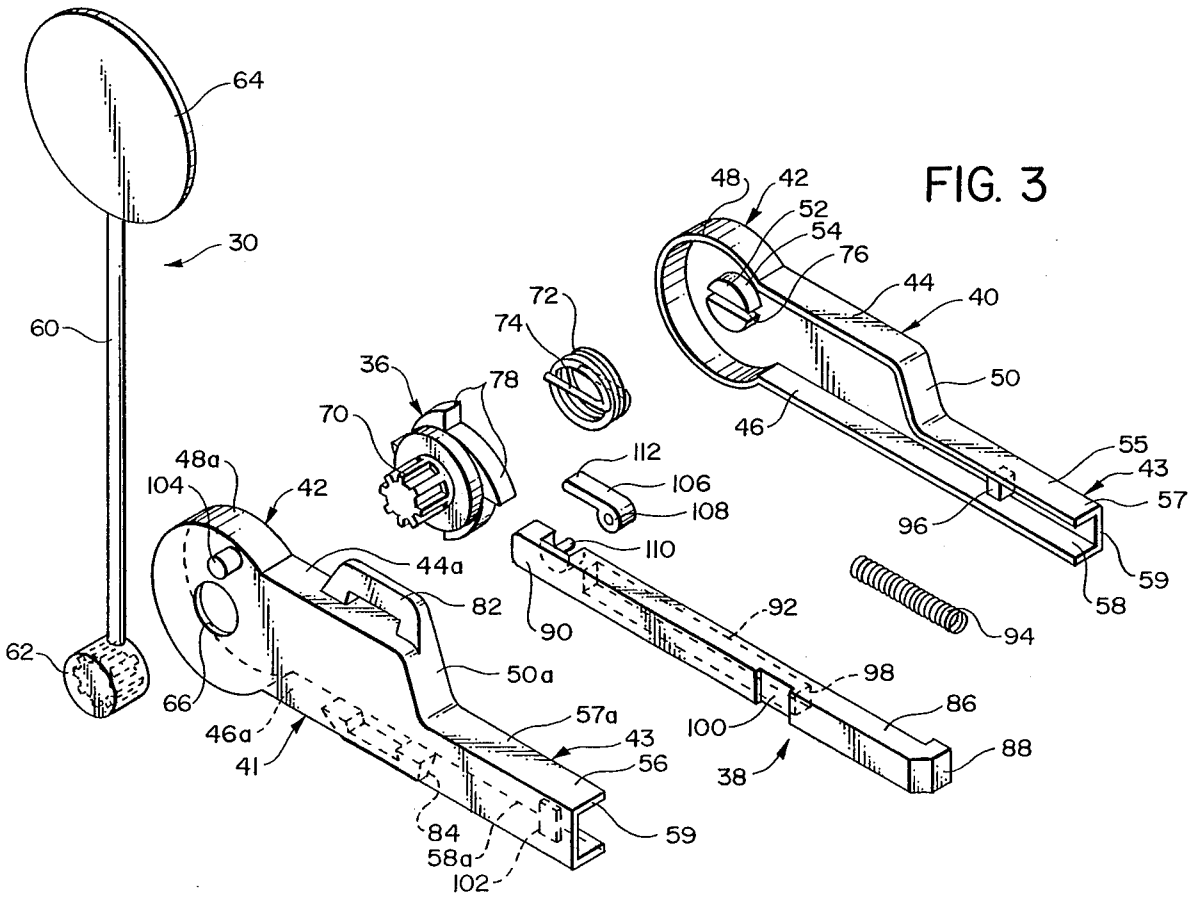
FIG. 3 is an exploded isometric view illustrating the components of the present invention separated from one another.
Figure 4:
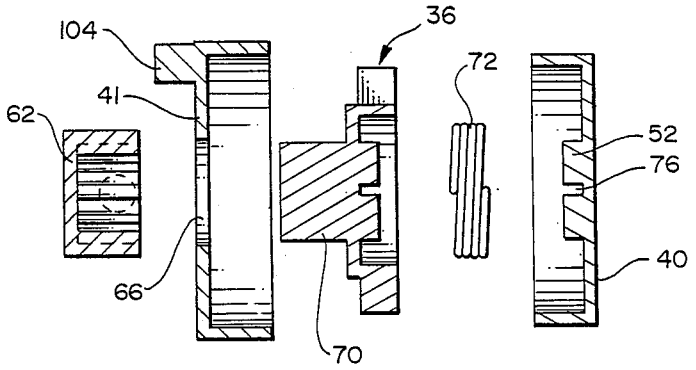
FIG. 4 is an exploded view taken along line 4—4 of FIG. 1, but showing only four components of the present invention.

To describe now the overall operation of the present invention, reference is first made to FIG. 3 to illustrate the manner in which the present invention can easily be assembled. Initially, the components of the actuating assembly 38 are put together first by placing the pivot end 108 of the locating finger 106 on its mounting pin 110 so that the finger 106 rests on the top rear surface portion of the rod member 86. The spring member 94 is positioned in the recess 100, and the rod member 86, along with the spring member 94 and finger 106 is placed in the elongate recess provided by the elongate housing section 55.

The locating member 36 is attached to an outer end of the spring 72 with the other end 74 of the spring 72 being fitted in the slot 76 of the stub 52. The locating member is then mounted to the stub 52. Then the second housing section 41 is mounted to the other housing section 40 so that the peripheral walls of the section 41 overlap (i.e. are positioned outside of) the corresponding peripheral walls of the housing section 40. As this is done, the rod member 86 is moved rearwardly against the compression of the spring 94 so that the stop member 102 properly fits in the recess 100. Also, the splined stub or axle 70 fits through the opening 66 in the housing section 41. The hub 62 of the signal flag 30 is then mounted to the splined stub 70. The hub 62 can be fixed to the splined stub 70 in some suitable means, such as by inserting a screw through the hub 62 and into the splined stub 70.

With the device 28 so assembled, the two strap sections 34*a* and 34*b* are attached to the handles 82 and 84, and the inner side surface of the housing 82 is positioned against the lower portion of one side 14 of the box 10, at a position moderately rearwardly of the front end of the box 10. The two strap sections 34*a* and 34*b* are then secured to one another and tightened by means of the buckle 83.

With the strap 34 properly tensioned, the forward elongate housing portion 43 extends substantially horizontally. Further, with the two strap sections 34*a* and 34*b* being in connecting relationship with the forward portion of the rear main housing portion 42, the entire signal device 28 is reasonably balanced so that the weight of the device 28 forwardly of the strap connection handles 82–84 is not sufficient to cause any significant downward deflection of the forward housing portion 43.

With the signal device 28 properly assembled and mounted to the box 10, the operation of the signal device 28 will now be described. If there is no external force exerted against the rod member 86, the spring 94 moves the rod member 86 forwardly to the extent permitted by the stop member 102 engaging the rear surface of the recess 100 in the rod member 86. In that position, the rear edge 112 of the positioning finger 106 is positioned just forwardly of the positioning member 36 so that the positioning teeth 78 are able to pass by the rear edge 112 of the finger 106 without making contact. Since the coil spring 72 is stressed in a manner to tend to rotate the flag 30 clockwise, if the flag 30 is in a downward position, the flag 30 will swing to its upward position where the signal member 64 is positioned above the top surface of the box 10 a moderate distance so as to be readily visible from a distance.

Now, let us assume that the mailbox door 18 has been closed, so that the lip 22 engages the forward end 88 of the rod member 86 so as to move the rod member 86 rearwardly a short distance. In this position, the rear edge 112 of the finger 106 is positioned so that it comes into engagement with the one or more teeth 78 as the positioning member 36 is rotated. In the hold position of FIG. 1, the end 112 of the finger 106 is positioned just beneath, and in engagement with, the contact surface of one of the teeth 78 so as to prevent clockwise rotation of the positioning member 36. Thus, the signal flag 30 is held in its down non-signalling position, where the signal member 64 extends rearwardly.

To review generally the day-to-day operation of the present invention, after the mailbox recipient has mounted the signal device 28 to the box 10, the door 18 is closed so as to move the rod member 86 rearwardly a short distance to the position shown in FIG. 1. Then, the rod 60 of the signal flag 30 is rotated in a rearward and downward direction until the flag 30 extends horizontally rearwardly. As this is done, the teeth 78 rotate upwardly against the finger 106 to push the locating finger 106 upwardly and out of the way, so that the one or more teeth 78 can pass by. When the tooth 78 passes by the finger 106, the finger 106 drops downwardly to rest in a horizontally extending position against the top rear surface portion 90 of the rod member 86. Then when the signal flag 30 is released, the positioning member 36 rotates a short distance until the tooth 78 comes into engagement with the outer edge 112 of the finger 106, and the signal flag 30 comes to a stop so as to be held in its rearwardly extending, non-signalling position.

Let it now be assumed that the postman comes to the mailbox 10, lowers the door 18, inserts the mail in the box 10, and then raises the door 18 to the closed position of FIG. 1. As soon as the postman opens the door 18, the flag 30 swings upwardly to the signal position of FIG. 2, where it is stopped by the stop member 104. The signal flag 30 remains in this position after the door 18 is closed by the postman.

At a later time, the mailbox recipient can, from a distance, observe that the signal flag 30 is in the raised position. The recipient then goes to the mailbox 10, lowers the door 18, removes the mail, and raises the door 18 back to its closed position. Then the recipient swings the signal flag 30 downwardly to a position moderately below the rearwardly extending non-signalling position of FIG. 1. When the signal flag 30 is released, the finger 106 will, in the manner described above, hold the flag 30 in the down position of FIG. 1 until the mailbox door 18 is again opened.

In the event that the positioning of the signal device 28 relative to box 10 is shifted moderately, it is a simple matter to adjust the position of the straps 34*a–b* to relocate the position of the box 10 precisely.

Further, the device 28 can be operated quite conveniently by the mailbox recipient. After the mail is removed from the box 10 and the door 18 is closed, the recipient will normally be carrying the mail in one hand, leaving the other hand free. It is a simple matter for the recipient simply to use the free hand to push the signal flag 30 down to its non-signal position. It is also readily apparent that the signal device 28 can readily be adapted for use with mailboxes of various sizes and shapes.

Figure 5:
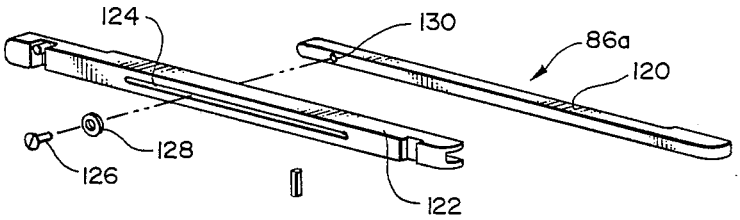
FIG. 5 is an isometric view of a modified form of the actuating rod of the present invention.

A modification of the present invention is shown in FIG. 5, where there is shown an actuating rod 86*a* made as two rod sections 120 and 122. The rod section 120 fits in an elongate U-shaped recess provided by the rod section 122. Further, the rod section 122 is formed with an elongate slot 124 to receive a positioning screw 126. The positioning screw 126 along with an associated washer 128 engages the rod section 122 at the location of the slot 124, with the screw 126 fitting in a matching opening 130 in the rod section 120. By loosening the screw 126, and then moving the rod sections 120 and 122 relative to one another, the length of the rod assembly 86*a* can be adjusted. The benefit of this particular modification is that it permits the precise location of the rod assembly 86, relative to the location of the door 18 to be adjusted without the necessity of loosening the straps 34*a* and 34*b*.

It is to be understood that various modifications could be made to the signal device 28 described above without departing from the teachings of the present invention.

I claim:

1. A signal device for a mailbox comprising a main containing structure with a sidewall and a door which is mounted at a forward end of the containing structure so as to be movable between a closed position and an open position, said device comprising:

a. a housing having a lengthwise axis and adapted to be mounted to an outside surface of the sidewall of the mailbox at a mounting location, said housing having a rear portion adapted to be positioned further from the forward end of the containing structure, and a forward housing portion extending forwardly from said rear portion toward the door of the mailbox, said housing comprising:

i. an inside housing section adapted to be positioned adjacent the mailbox sidewall;

ii. an interior housing section adapted to fit alongside of and interfit with the inside housing section so as to close said inside housing section;

b. a signal member having a pivot end mounted to said rear housing portion for rotation about a generally horizontal axis of rotation, and a signal end spaced from the axis of rotation, said signal member being movable about said axis of rotation between a down non-signalling position and an up signalling position;

c. a locating member connected to the pivot end of the signal member and having a locating element;

d. an actuating member extending along said lengthwise axis and mounted in the forward housing portion for limited fore and aft movement between a rear hold position and a forward release position, said actuating member being positioned adjacent a lengthwise extending wall portion of said housing, said actuating member having a forward contact surface adapted to engage a side edge portion of the mailbox door when the door is in its closed position;

e. said actuating member and said housing wall portion having cooperating stop means comprising a stop recess formed in one of the housing wall portions and the actuating member, and a stop member mounted to the other of the housing wall portion and the actuating member and positioned in the stop recess for limited fore and aft movement to limit movement of the actuating member between said hold position and said release position;

f. a catch member mounted to the rear end of the actuating member and having a catch position where it engages the locating element of the locating member to hold the signal member in its nonsignalling position when the actuating member is in its hold position, and having a release position to permit said signal member to move to its signalling position when the actuating member is in its release position;

g. at least one of said actuating member and said housing wall portion defining a spring recess to receive an actuator spring, said housing having a first spring engaging portion to engage said actuator spring, said actuating member having a second spring engaging portion to engage said actuator spring in a manner to urge said actuating member to its release position;

h. a mounting strap adapted to be connected to upper and lower portions of said exterior housing section and to extend around the mailbox to hold the signalling device substantially stationary at the mounting location and to hold the exterior housing section in closing engagement with the inside housing section.

2. The device as recited in claim 1, wherein there are upper and lower handle members connected to, respectively, upper and lower portions of said exterior housing section, and said strap is adapted to engage both of said handle members to hold the exterior housing section in engagement with the inside housing section.

3. The device as recited in claim 1, wherein the actuating member is an elongate member, the length of which is adjustable to allow for variations in engagement with the mailbox door.

4. The device as recited in claim 3, wherein said actuating member comprises two elongate sections interfitting with one another, and adjustable fastening means adapted to lock said two actuating sections relative to one another.

5. The device as recited in claim 1, wherein said catch member comprises a catch finger pivotally mounted adjacent the rear end of the actuating member, said catch finger being located, with the actuating member in its hold position, in a path through which the locating element travels in movement of the signal member between its signalling position and its non-signalling position, said catch finger being deflectable upwardly when contacted by said locating element when the locating member is moving back to the hold position, and movable back to a hold position to hold the signal member in its non-signalling position.

6. The device as recited in claim 1, wherein said strap is connected to upper and lower forward portions of the rear housing portion, whereby said device is reasonably balanced between forward and rear portions of said device relative to the strap.

7. The device as recited in claim 1, wherein said housing has a mounting hub on which said locating member is rotatably mounted, and there is a coil spring interfitting with said hub and said locating member to urge the locating member and the signal member to the signalling position.

8. The device as recited in claim 1, wherein said actuator spring is a compression spring and said first spring engaging portion of said housing is a rear spring stop member, and said second spring engaging portion is a surface portion of said actuating member.

9. The device as recited in claim 1, wherein:

a. there are upper and lower handle members connected to, respectively, upper and lower portions of said exterior housing section, and said strap is adapted to engage both of said handle members to hold the exterior housing section in engagement with the inside housing section;

b. said catch member comprises a catch finger pivotally mounted adjacent the rear end of the actuating member, said catch finger being located, with the actuating member in its hold position, in a path through which the locating element travels in movement of the signal member between its signalling position and its non-signalling position, said catch finger being deflectable upwardly when contacted by said locating element when the locating member is moving back to the hold position and movable back to a hold position to hold the signal member in its non-signalling position;

c. said housing has a mounting hub on which said locating member is rotatably mounted, and there is a spring means interfitting with the hub and the locating member to urge the locating member and the signal member to the signaling position.

* * * * *